US005418698A

United States Patent [19]

Wu

[11] Patent Number: 5,418,698

[45] Date of Patent: May 23, 1995

[54] DECORATIVE LIGHTING STRING PUSH-IN TYPE LIGHTING SOCKET UNIT

[76] Inventor: Jeng-Shyong Wu, Fl. 4 No. 5, Hsing Shyue Road, Hsin-Chu City, Taiwan, Prov. of China

[21] Appl. No.: 906,790

[22] Filed: Jun. 30, 1992

Related U.S. Application Data

[63] Continuation-in-part of Ser. No. 862,452, Apr. 2, 1992, abandoned, which is a continuation-in-part of Ser. No. 756,925, Sep. 9, 1991, abandoned.

[51] Int. Cl.[6] ..... F21P 1/02

[52] U.S. Cl. ..... 362/252; 362/226; 362/389; 362/806

[58] Field of Search ..... 362/122, 123, 226, 249, 362/252, 382, 389, 806, 457, 392, 444

[56] References Cited

U.S. PATENT DOCUMENTS

| | | | |
|---|---|---|---|
| 2,542,361 | 2/1951 | Roxburgh | 362/806 |
| 2,726,322 | 12/1955 | Alperia et al. | 362/392 |
| 4,667,276 | 5/1987 | Cheng | 362/249 |
| 4,679,126 | 9/1987 | Van Sickler | 362/226 |
| 4,704,668 | 11/1987 | Kosek | 362/389 |
| 4,970,632 | 11/1990 | Tsang | 362/226 |
| 5,001,615 | 3/1991 | Stefanelli | 262/226 |
| 5,199,783 | 4/1993 | Pelton | 362/226 |

*Primary Examiner*—Ira S. Lazarus
*Assistant Examiner*—Y. Quach
*Attorney, Agent, or Firm*—Bucknam and Archer

[57] ABSTRACT

Decorative lighting string push-in type socket unit has a lamp bulb, a lamp base, a lamp holder and an insert for frictional fitting of the bulb, the base and the holder, wherein the insert is made of an elastic material in a form that is convenient to be selectively inserted interfacing between the lamp bulb and the lamp base, the lamp base and the lamp holder to make possible the stable fitting of the instant push-in assembly of the unit. The frictional force is exerted through the embossment of a raised surface in a dotted or ribbed pattern when the insert is in the form of a strap; or a pattern simulating a screw thread when the insert is in the form of an insertable nipple or bushing. The strap form insert can be made into a continuous length or may be divided into halves or sections. In addition to the abovesaid embossment, folding lines, snap holes and conductor passages can also be optionally provided thereupon. Strap(s) can be applied as an independent piece or can be integrally fabricated onto any desired point along the circumferences of the lamp base and/or the lamp holder. To facilitate stable security of the different parts without twisting or vibration, anchoring projections or lugs are provided wherever the strap needs to be snapped on.

12 Claims, 21 Drawing Sheets

DECORATIVE LIGHTING STRING PUSH-IN TYPE LIGHTING SOCKET UNIT

This application is a continuation-in-part of Ser. No. 862,452, filed Apr. 2, 1992, which is a continuation-in-part of U.S. Ser. No. 756,925, filed Sep. 9, 1991. Ser. Nos. 862,452 and 756,925 have been abandoned.

BACKGROUND OF THE INVENTION

The present invention relates generally to a push-in type pocket unit in a decorative lighting string and more particularly to a push-in type socket unit having frictional insert means provided interfacingly between relative members thereof. Said unit usually comprises a lamp bulb, a lamp base retaining said lamp bulb and a lamp holder to hold the bulb and base assembly.

In a conventional push-in type socket unit, the bulb is a bare glass body without any metal component such as a screw head attached thereon. Only a pair of conductor wires leading from the filament inside the bulb appears at the rear end of the glass body. The wires are intended to get into contact with a pair of terminals disposed beforehand within the lamp holder when the bulb and base assembly is pushed into said holder. The terminals are in turn to be connected to the power source of the string.

Members of such a conventional push-in unit are held together by their self-containing frictional force with a risk that slippage may cause inadvertent separation of the members.

SUMMARY OF THE INVENTION

The main object of the present invention is to provide means to ensure the stable holding together of the unit members so that they do not get loose, twisted or slip off. These means are made of flexible or elastic material having roughened surfaces to be inserted interfacingly between the bulb and the lamp base, lamp base and lamp holder to enhance the frictional contact therebetween to increase the reliability of the assembly.

Another object of the present invention is to provide frictional insert means in a strap form provided with folding line, conductor passages, surface roughenings optionally with dots, ribs embossed thereon, and also snap holes or slots for fastening to a corresponding anchoring means disposed on the rim of the related parts such as the lamp base, the lamp holder, etc. This strap may be used in the entire length or in broken sections, independently or integrally formed with the base or the holder.

A further object of the present invention is to provide frictional insert means which is in the form of a bushing or a nipple having its internal and/or external circumferences carved with threads, so as to frictionally engage the bulb and the lamp base or the lamp base and the lamp holder tightly together.

BRIEF DESCRIPTION OF THE DRAWINGS

Other objects and features will become apparent when the description of preferred embodiments is taken in conjunction with the annexed drawings, of which:

FIG. 3A is in a full length having every possible feature disposed thereon including folding lines, passage holes and with a longitudinal ribbed roughening on the surface;

FIG. 3B is similar to FIG. 3A, only with a lateral or crosswise ribbed roughening;

FIG. 3C is also similar to FIG. 3A, only with a dotted face roughening.

FIG. 3D is a strap resembling FIG. 3B, but without snap slots at both ends.

FIG. 4A is a bi-sectionalized strap that is broken at the center with conductor wire passage cancelled;

FIG. 4B is a sectionalized strap without snapping slot.

Figure 1:
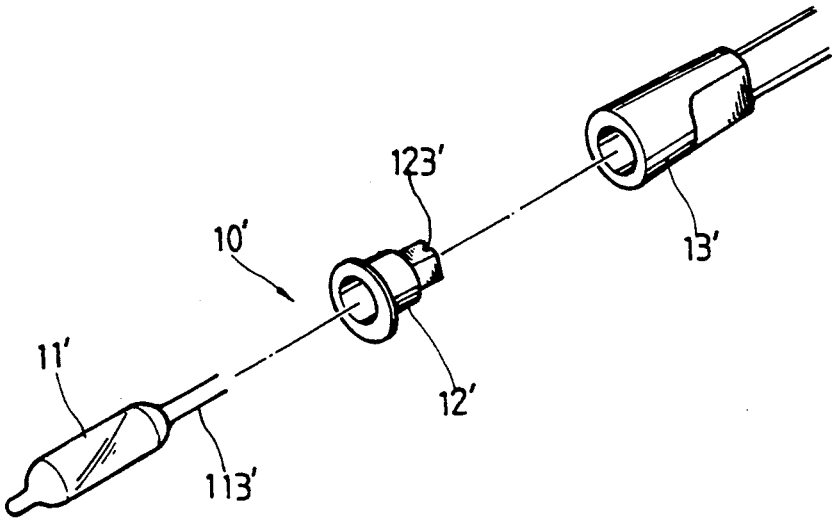
(PRIOR ART) FIG.1
FIG. 1 is an exploded perspective view showing the main components in a conventional push-in type socket unit.

Now referring to FIG. 1, a conventional push-in type socket unit 10' comprises a lamp bulb 11' to be pushed in a lamp base 12' which is in turn pushed into a lamp holder 13' to complete the assemblage. A pair of conductor wires 113' leading from the rear end of said bulb 11' is to pass through the rear end opening 123' of the lamp base 12' to get into contact with a pair of predisposed terminals connected to the power source of the-decorative lighting string. The holding together of the components is effected through the self-containing frictional force between contacting surfaces which is not so reliable as to prevent slippage and loosening of the members of the unit so formed.

DESCRIPTION OF PREFERRED EMBODIMENTS

Figure 2:
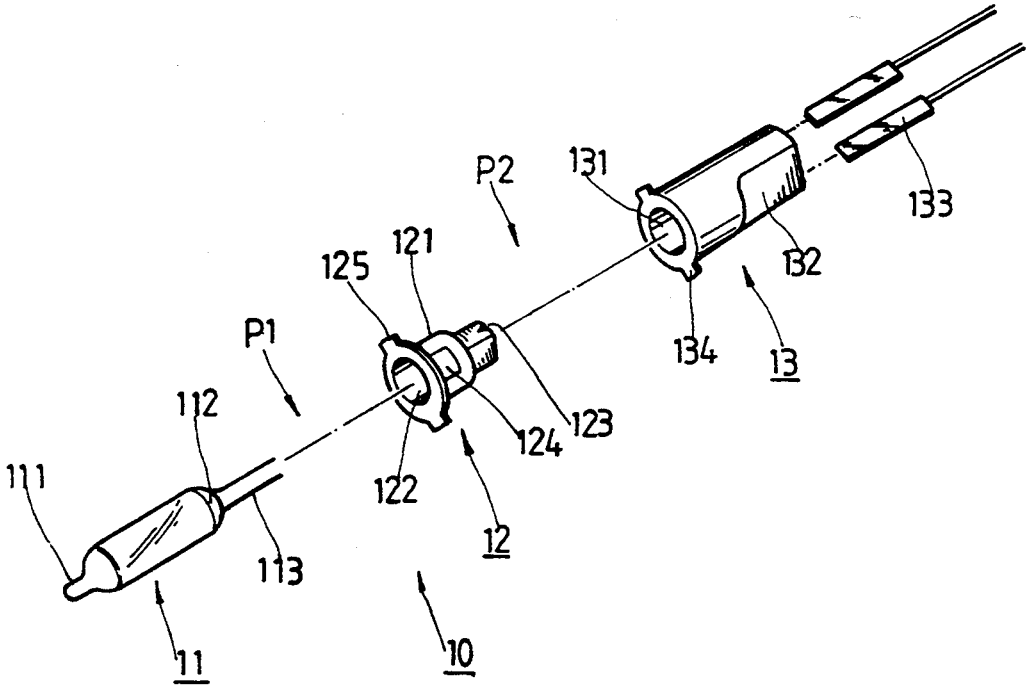
FIG. 2 is an exploded view of an embodiment of the push-in type socket unit of this invention in which the frictional insert is not substantially shown, yet with arrows showing the applicable positions P1, P2 of such inserts.

FIG. 2 shows an exploded view resembling FIG. 1 depicting three main components of the novel push-in type lightening socket unit 10 of the present invention, comprising a lamp bulb 11, a lamp base 12 and a lamp holder 13. A fourth main component i.e. the insert means is not shown in FIG. 2 but with the positions P1 and P2 of possible employment depicted with respective arrows. Said fourth component insert means may be in the form of a strap or of a nipple or bushing and made of elastic material as detailed later on in FIGS. 3 to 5 and their applications elaborated in FIG. 6 through 22 as embodiments illustrated.

The lamp bulb 11 in the novel push-in type lighting socket unit 10 is a bare glass bulb having a front end 111 and a rear end 112. A pair of conductor wires 113 lead out from the filament within the bulb sticking out of the rear end 112.

The bulb 11 is intended to be pushed into a lamp base 12 which has a stepwise body 121 with a front end opening 122 to take the bulb 11 and a rear end opening 123 with notches provided-to anchor the conducting wires 113 led out from the end 123. Through the wall of the body 121, a pair of apertures 124 are disposed diametrically to enhance the frictional effect accompanying the insert means used which is to be further explained in the description of embodiments. At the rim of the opening 122, lug(s) 125 are optionally disposed for the snap-anchoring of the strap type insert means.

The lamp holder 13 has a front opening 131 to take the incoming rear end of the base 12. Prearranged in the rear opening 132 of the holder 13 is a pair of terminals 133 which are to be contacted by the conductor wires 113 passing through the lamp base 12 and being bent over rear opening 123 when the said base 12 is pushed in through the opening 131 of the lamp holder 13. Lugs 134 are also optionally provided at the front end opening 131 of the holder 13 serving the same purpose like the lugs 125 do. The mechanism thereof will be detailed along with the embodiments.

In the embodiments exemplified later on the fourth component of the present unit, i.e. the insert means capable of being inserted in position P1 can be any of the two types, that is, strap type or bushing (nipple) type, while in position P2 only bushing (nipple) type prevails.

Figure 3A:
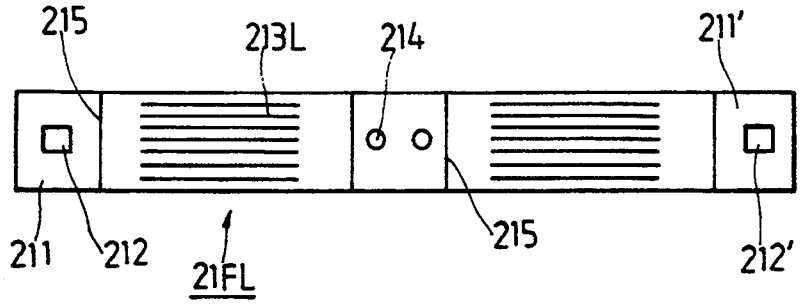
FIGS. 3A to 3D depict variations of a piece of strap type frictional inserts, in full length where.
Figure 3B:
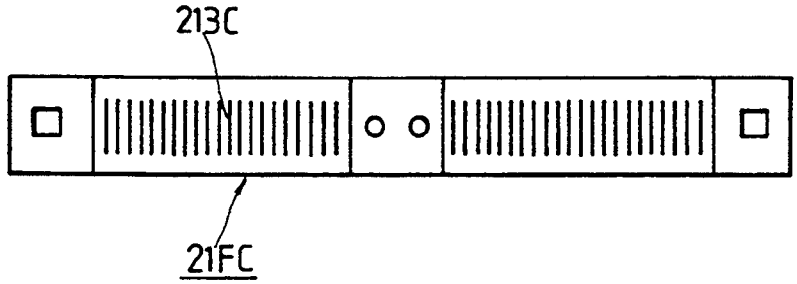
Figure 3C:
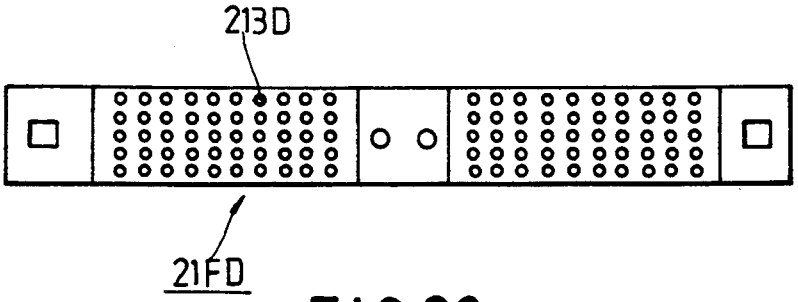
Figure 3D:
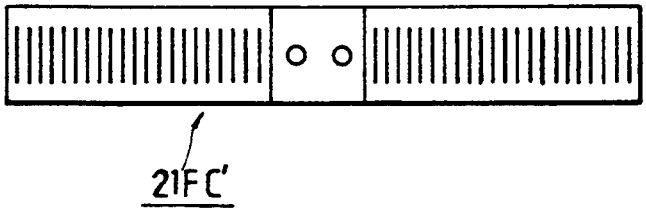

FIGS. 3A to 3C depict three full length strap type insert means 21FL, 21FC and 21FD which have adjacent to two ends 211–211' snapping slots or holes 212–212' respectively for snap anchoring or fastening on the lugs such as 134 provided on the lamp holder 13 aforementioned. A pair of conductor wire passages 214—214 is deployed in the middle of the full length strap 21FL to take readily conductor wires led out from the rear end of the lamp bulb when the strap is to take position P1 interfacingly between the bulb 11 and the lamp base 12. In between the snapping slot 212 and the passage pair 214, raised face roughenings in the form of longitudinal ribs 213L (FIG. 3A), cross or lateral ribs 213C (FIG. 3B) or embossment 213D (FIG. 3C) are provided respectively for the 21FL type strap, 21FC type or 21FD type straps shown in FIGS. 3A to 3C. Folding lines 215 are grooved wherever applicable on all strap type inserts.

Figure 4A:
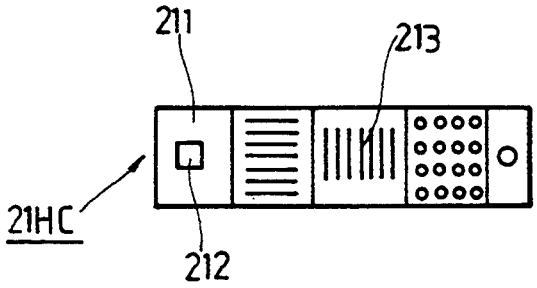
FIGS. 4A and 4B depict variations of a sectionalized strap type frictional insert where the right end is intended to be made integrally with the lamp base or the lamp holder.

Other than employed in full length, the insert strap may be in a half-length bisect 21C such as shown in FIG. 4A where the conductor passages 214 are eliminated since they are no more required.

Figure 4B:
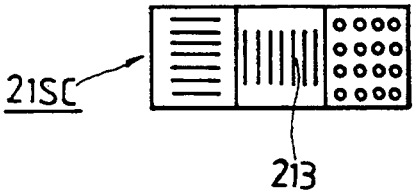

This can best be seen in FIG. 9 and descriptions will be provided later, where the half-length one 21C is further simplified to leave out the snap slot 212 to become an even shorter section 21SC (FIG. 4B).

Figure 5:
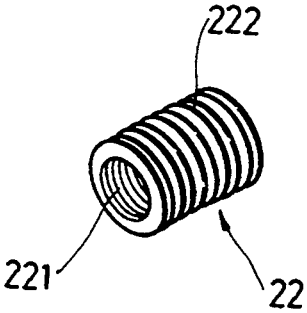
FIG. 5 is a perspective view showing a bushing or nipple type insert means.

FIG. 5 is a perspective view showing the nipple (bushing) type insert means of the present invention wherein the cylindrical insert body 22 is made of elastic material, with threads 221 and 222 carved respectively around the inner and outer circumference.

Figure 13A:
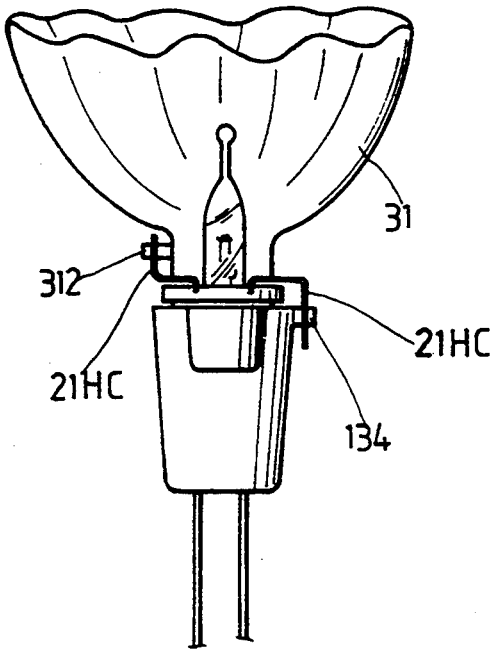
Figure 13B:
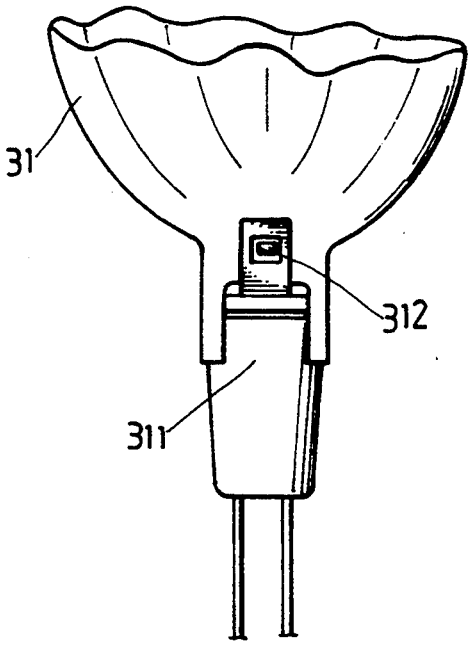
Figure 13C:
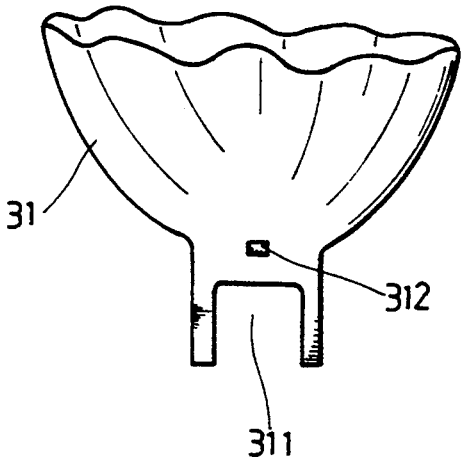
Figure 14A:
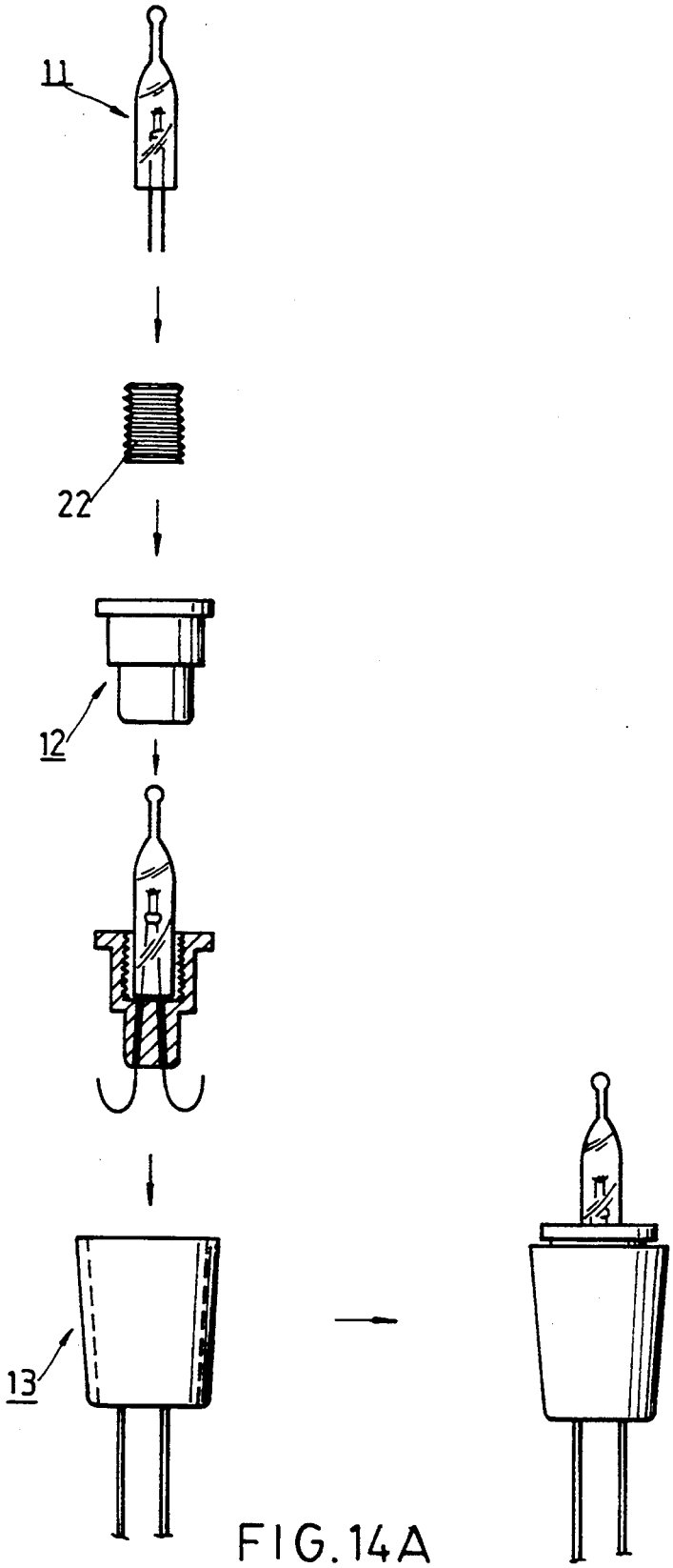
Figure 14B:
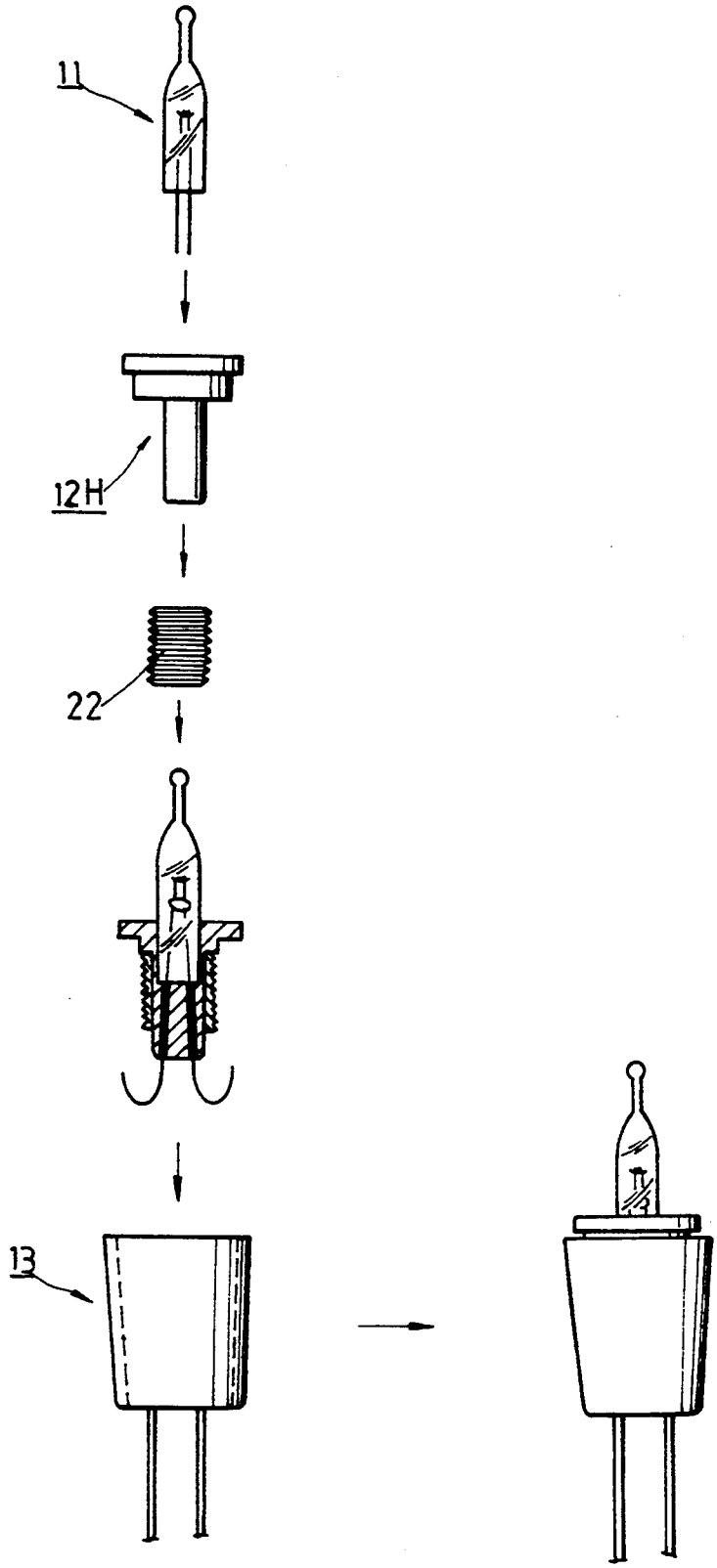

This nipple (bushing) is to be applied in between the bulb and the lamp base or the lamp base and the lamp holder like a sleeve, such as shown in FIGS. 14A and 14B. FIG. 6 through FIG. 22 are embodiments showing application of the insert means of the present invention in variations for the purpose of illustration but not limitation. They are tabulated in Table I for clarity and descriptions will also follow.

TABLE I

Embodiments of the application of insert means of the present invention

| FIG. | Insert means type | | Identification particular | | | Served in-between | | | |
|---|---|---|---|---|---|---|---|---|---|
| No. | strap | nip. | | | FIG. | lamp bulb | lamp base | lamp holder | acc. |
| 6 | ind. | — | 21F | P | 3B | x | x | lug | |
| 7 | ind. | — | 21F' | P | 3D | x | w/hole | x | |
| 8 | on base | — | 21F' | P | 3D | x | x | | |
| | x1 | — | | | | | | | |
| 9 | on base | — | 21F' | P | 3D | x | x | | |
| | x2 | — | | | | | | | |
| 10 | on base | — | 21F' | P | 3D | x | x | | |
| | x1 | — | | | | | | | |
| 11A | on base | — | 21S | | 4B | x | stepped | | |
| 11B | on base | — | 21S | | 4B | x | x | | |
| 11DE | on base | — | 21S | | 4B | x | stepped | | |
| 12 | on holder | — | 21S | | 4D | x | x | | |
| | x2 | — | | | | | | | |
| 13 | on base | — | 21H | | 4A | | x | lug | lug |
| | x2 | — | | | | | | | |
| 14A | — | x | 22 | | 5 | x | x | | |
| 14B | — | x | 22 | | 5 | | stepped | x | |
| 15 | ind. | — | 21F | P | 3B | | x | lug | |
| 16 | ind. | — | 21F | P | 3B | x | x | lug | |
| 17 | ind. | — | 21F' | P | 3D | | x | x | |
| 18 | Ind. | — | 21F' | P | 3D | x | x | x | |
| 19 | ind. | — | 21F | P | 3D | x | x | x | |
| 20 | ind. | — | 21F | P | 3D | x | x | x | |
| 21 | on base | — | 21S | | 4B | x | x | x | |
| | x2 | — | | | | | | | |
| 22 | on base | — | 21S | | 4B | x | x | x | |
| | x4 | — | | | | | | | |

Note:
F: full length
S: sectional
': less slots
P: w/conductor passage

It is to be noted here that all the embodiments use straps of lateral ribbed roughening for simplification, but different longitudinally ribbed or dotted ones can also be applied on one side or both sides of the strap.

Figure 6:
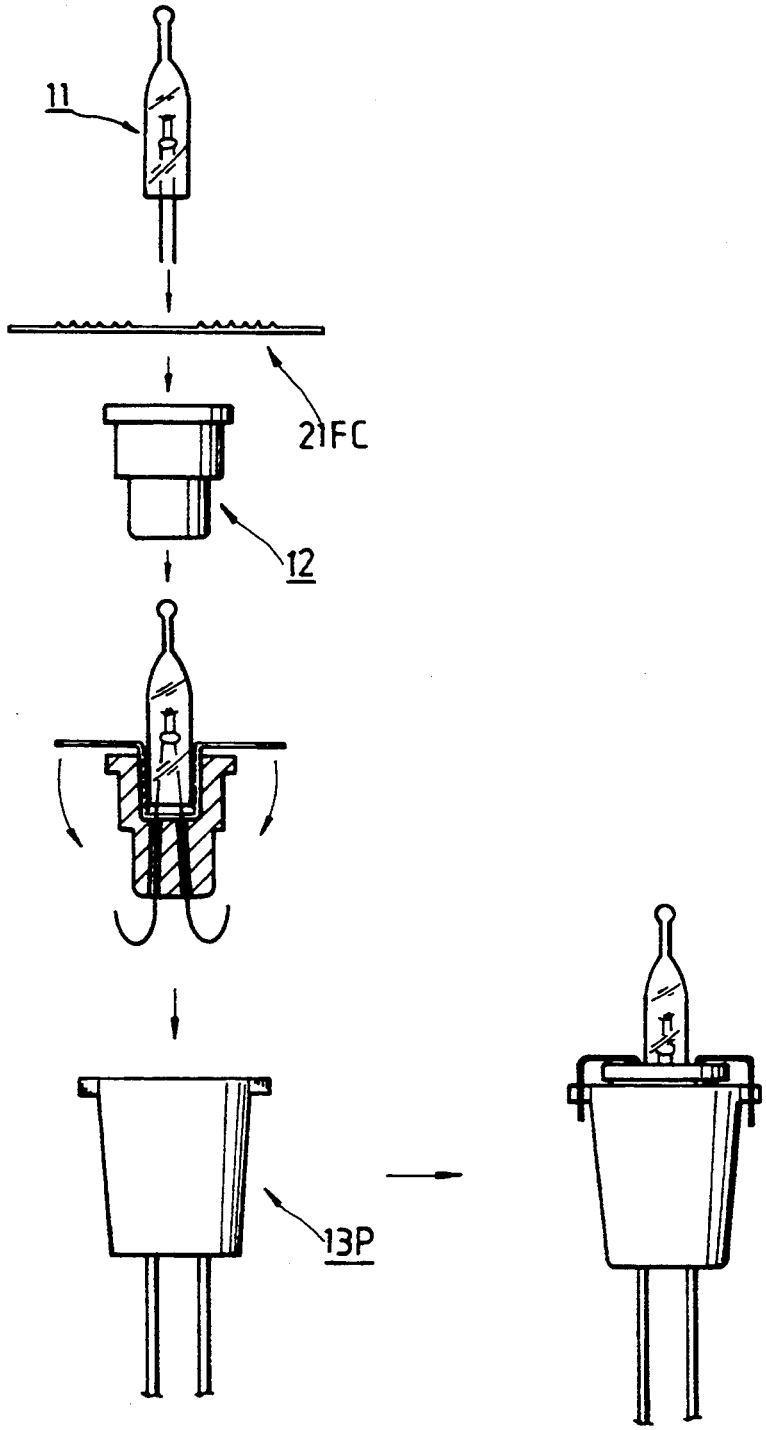
FIG. 6 is a schematic drawing application combination of 11/21FC/12/13P, that is bulb 11, strap FC, lamp base 12, lamp holder 13P.

It can be seen in FIG. 6 that the full length strap 21FC is inserted between the bulb and the base 12, the ribs are tightly pressed by the bulb, so that the bulb 11 and the base 12 are securely assembled. At the rim of the lamp holder 13P, lugs or projections 134 are provided to be anchored by the slot 212 of the strap 21FC after the bulb-base assembly is in turn pushed in the lamp holder 13P.

Figure 7:
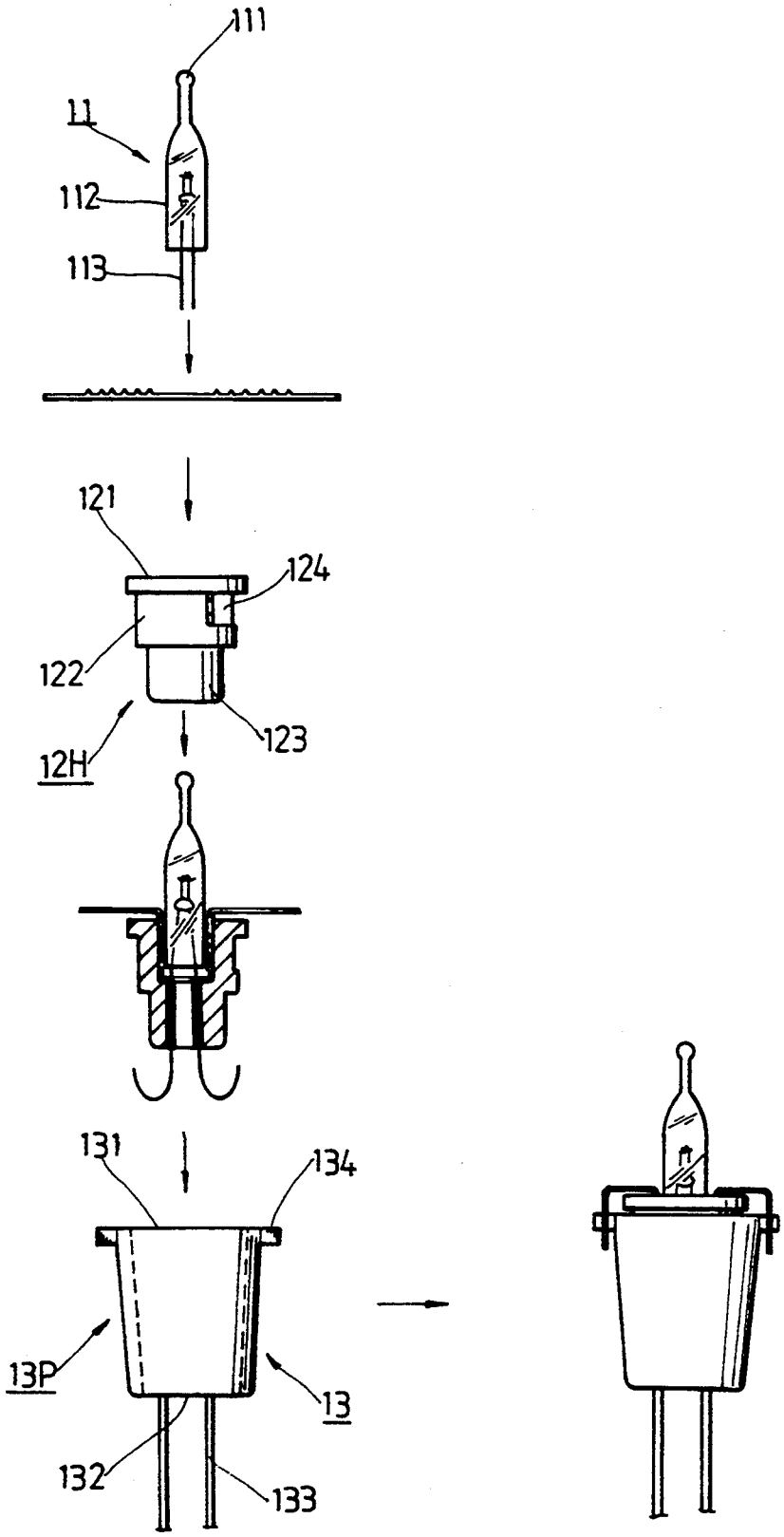
FIG. 7 is a schematic drawing application combination of 11/21FC/12H/13P that is bulb 11, strap FC, lamp base 12, lamp holder 13P.

The embodiment shown in FIG. 7 resembles that of FIG. 6, but the lamp base 12H is provided with diametrically disposed apertures or holes 124 on the wall.

Figure 8:
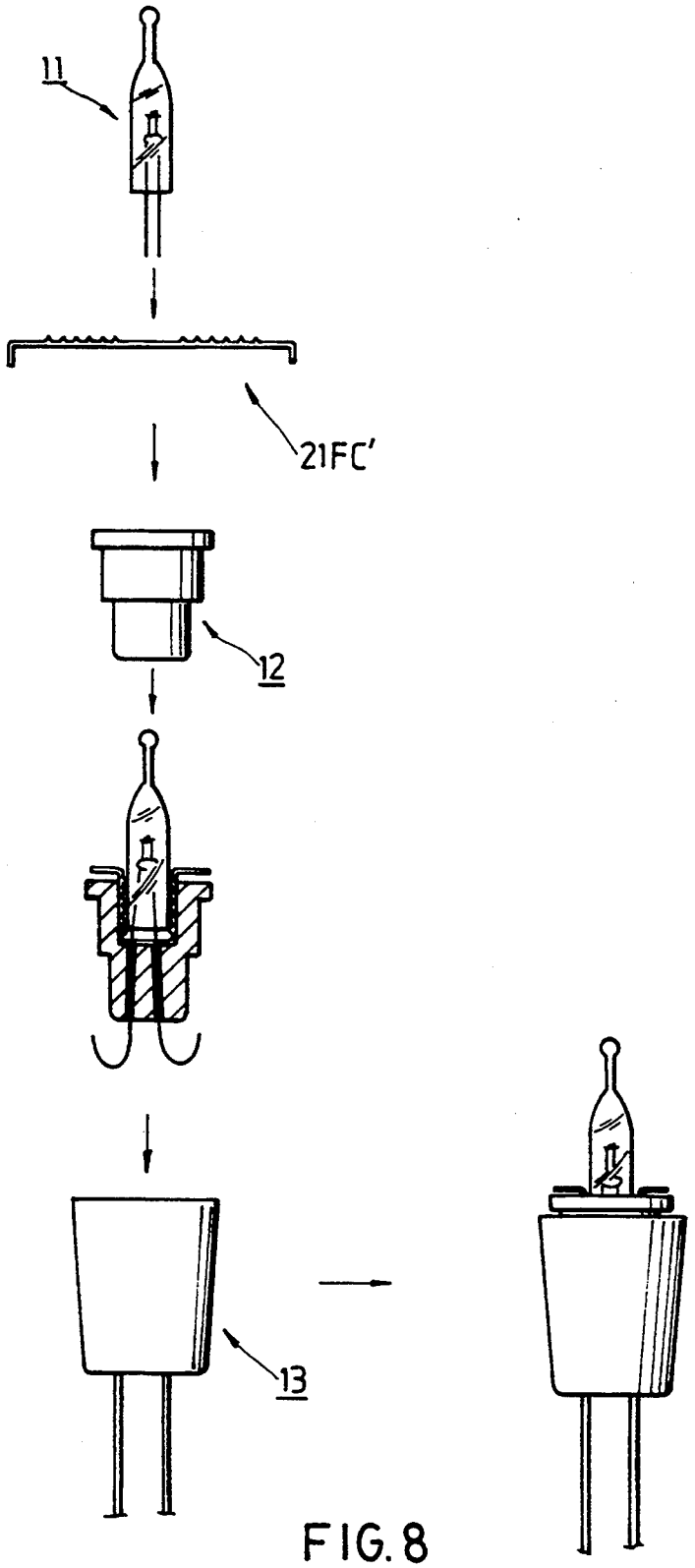
FIG. 8 to FIG. 22 A, B and C illustrate embodiments employing the frictional inserts of the present invention to facilitate the sure holding of the push-in type socket unit as well as the attachment of the accessories, such as a reflector, thereon.

FIG. 8 resembles FIG. 6, however a strap 21FC' is used instead of 21FC, the snapping slots 212 are eliminated at both ends, therefore, the two ends 211' of the strap are dangled and unanchored.

Figure 9:
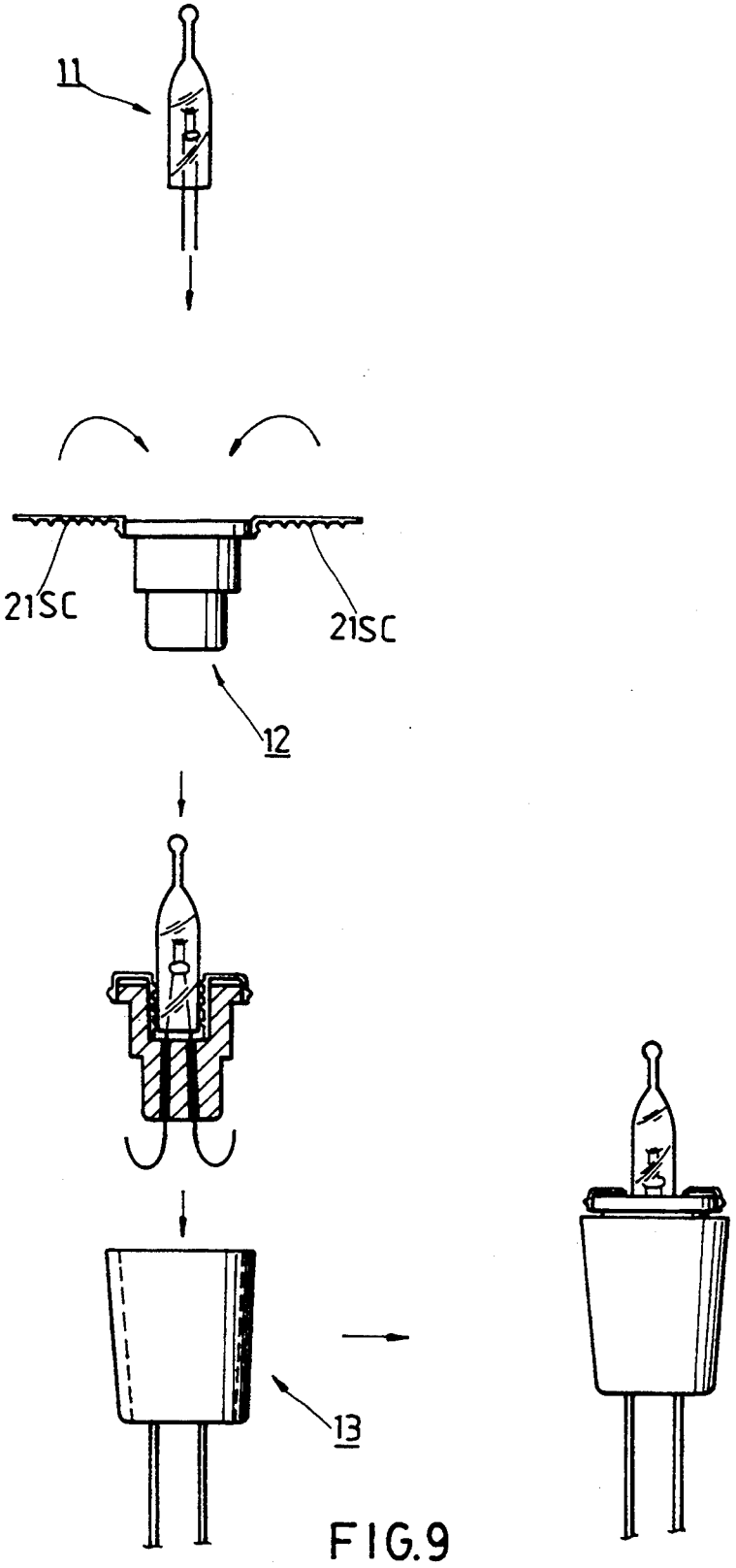
Figure 10:
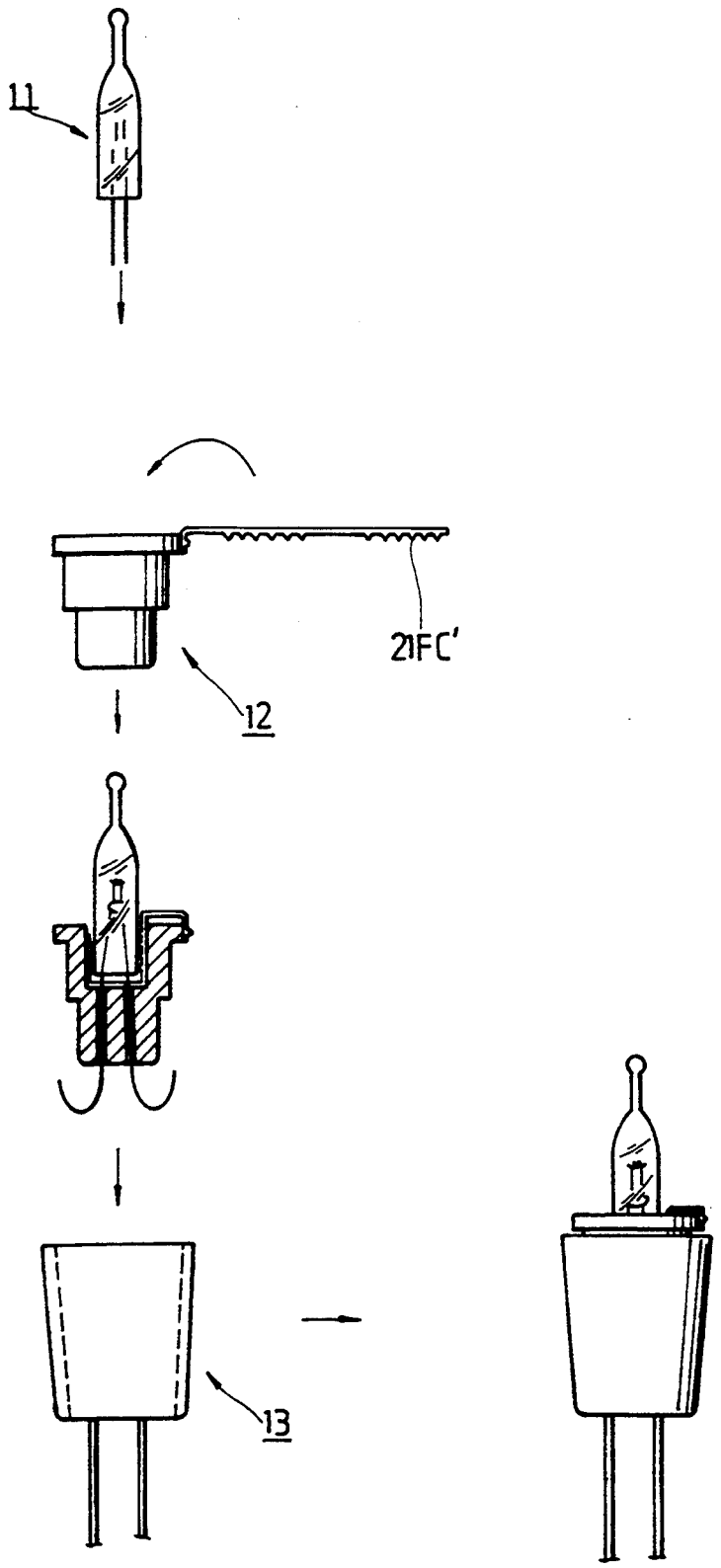

In FIGS. 9 and 10, both use lamp base 12 having no apertures on wall. Two strap 215SC are sectionalized and are made integrally to the rim 126 of the lamp base 12. Straps 215SC are bent inwardly over the end opening 122 to be frictionally inserted interfacingly between the bulb 11 on the base 12.

In FIG. 10, the strap is of type 21FC', full length without snapping holes (FIG. 3D) and with one end attached integrally to the rim 126 of the lamp base 12H. The strap 21FC' has provided conductor passage 214 so that when the strap is inwardly bent over the end opening 122 to be insert in between the bulb 11 and the base 12, conductor wires 113 are allowed to pass through the passages 214.

Figure 11A:
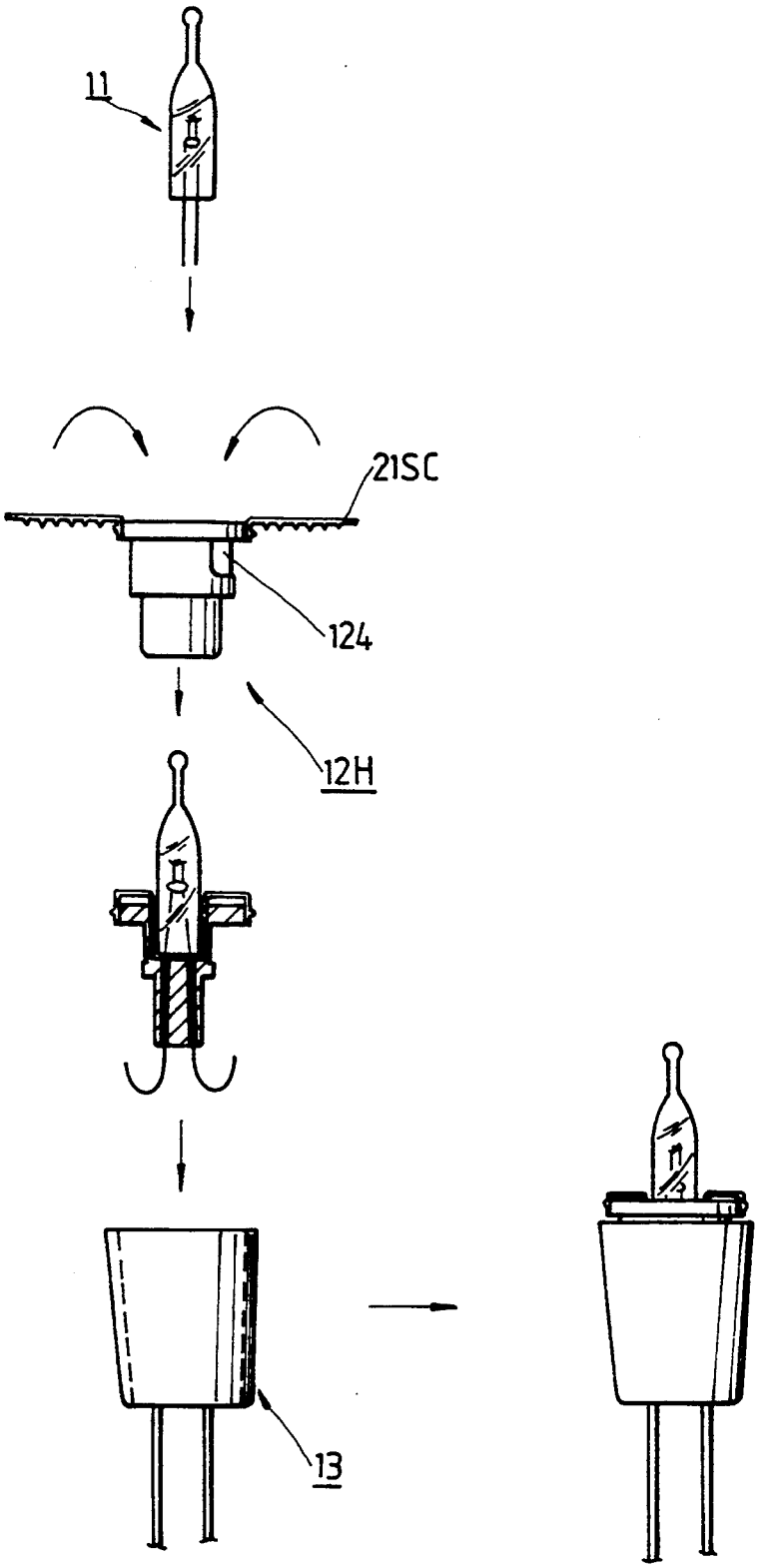

FIGS. 11A to 11C resemble FIG. 9 with the two exceptions that the lamp base 12H having wall apertures 124 is employed and the attaching points vary from 126 at upper rim to 127 on the middle rim step and 128 on the lower rim step of the multi-stepped base 12H. The strap sections may be bent down (FIG. 11B) or up (FIG. 11C) to be inserted between the base 12H and the holder 13.

Figs. 11D and lie resemble FIG. 9 and 11A respectively. However, the attaching points of the straps 21SC are at the rear end of a lamp base 12.

Figure 12A:
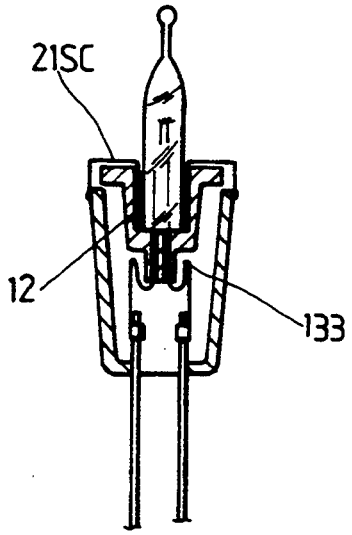
Figure 12B:
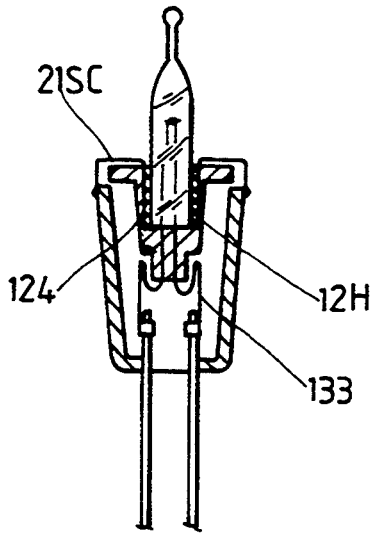

In FIGS. 12A and 12B the embodiment shows attachment of two straps 21SC to the top rim of the lamp holder with the straps being bent inwardly to insert between the bulb 11 and the lamp base 12, and base 12H is used instead of 12 in FIG. 12B.

FIGS. 13A and B show the application for attaching accessory (such as a lamp reflector 31) to the socket unit. Two strap sections 21HC with snapping holes 212 at their end are made integrally with the lamp base 12 and disposed diametrically across the rim of the base. The first of the straps 21HC is bent down to anchor at a lug or projection 134 at the holder rim while the second one is bent upward to pass through a notch 311 of the reflector 31 and to fasten the reflector through a lug 312 provided thereon.

FIGS. 14A and 14B are embodiments employing insert means of nipple or (bushing) type. FIG. 14A shows the nipple 22 is inserted between a lamp bulb 11 and a lamp base 12, while FIG. 14B shows the same is inserted between a lamp base 12H with wall apertures 124 and a lamp holder 13.

Figure 15:
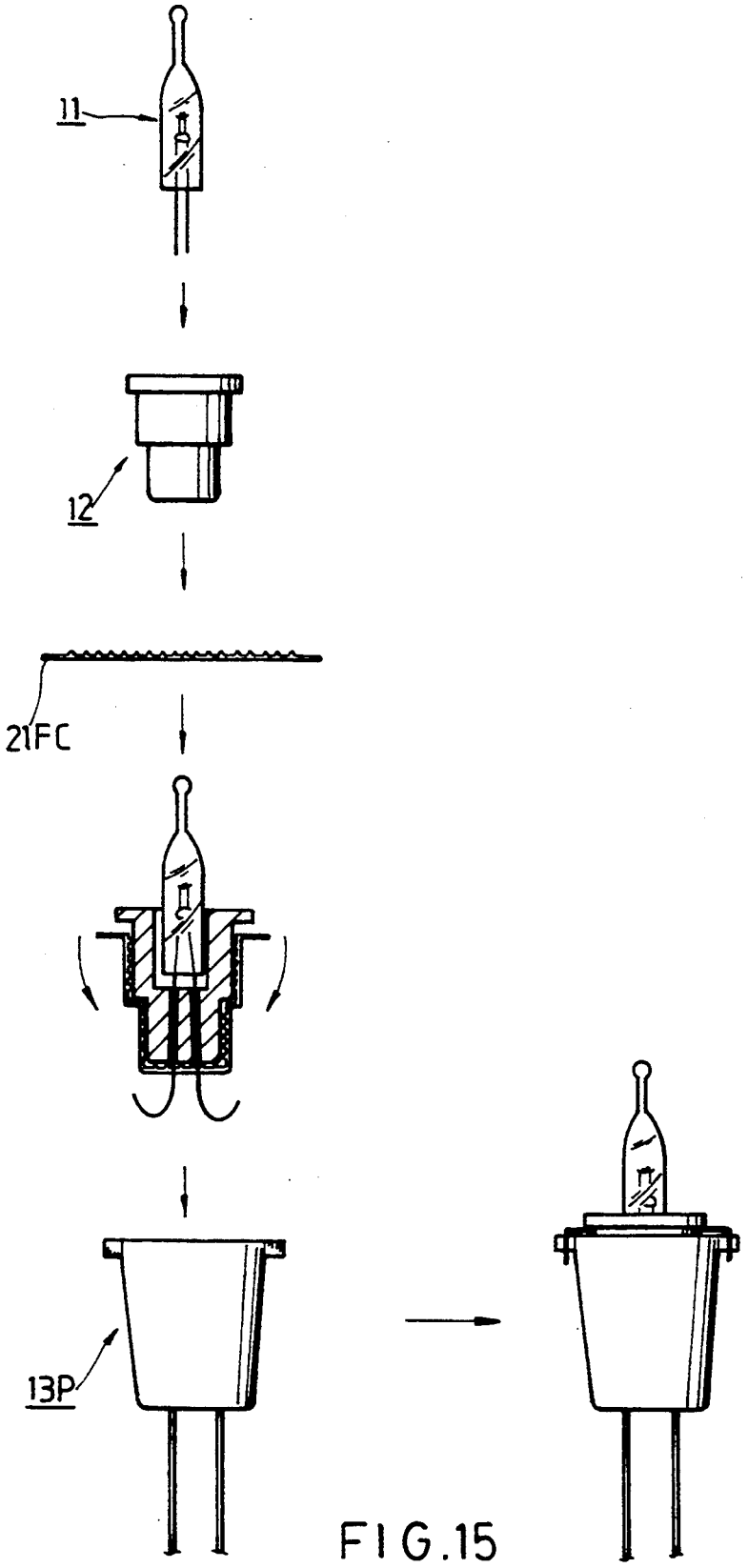

In FIG. 15, another embodiment is shown with the full length insert strap 21FC being inserted between the lamp base 12 and the lamp holder 13P. At the rim of the lamp holder 13, lugs or projections 134 are provided to be anchored by the slot 212, 212' of the insert strap 21FC after the bulb, the base and the holder are completely assembled.

Figure 16:
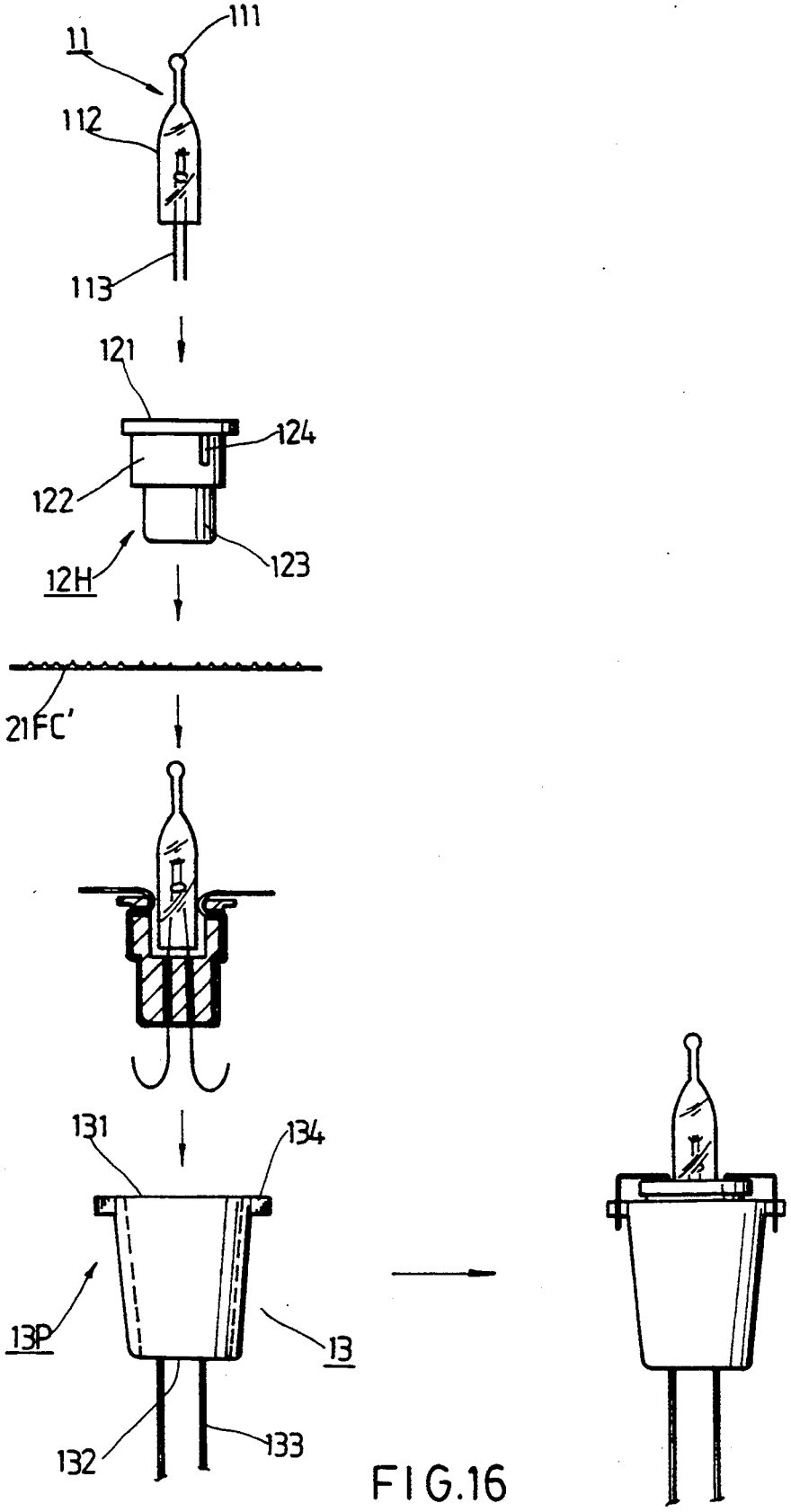

In FIG. 16, still another embodiment is shown with the full length insert strap 21FC being inserted between the lamp base 12H and the lamp holder 13P, and the lamp base 12H has at least two holes 124 under its rim facing diagonally. The ends of the insert strap 21FC are inserted through these two holes respectively and bent over above the rim so that either the lamp and the base or the base and the holder can be secured frictionally by the insert strap. Then the slots of the insert strap 21FC are anchored on the lugs 134 of the lamp holder 13P when the lamp-base-holder is completely assembled.

Figure 17:
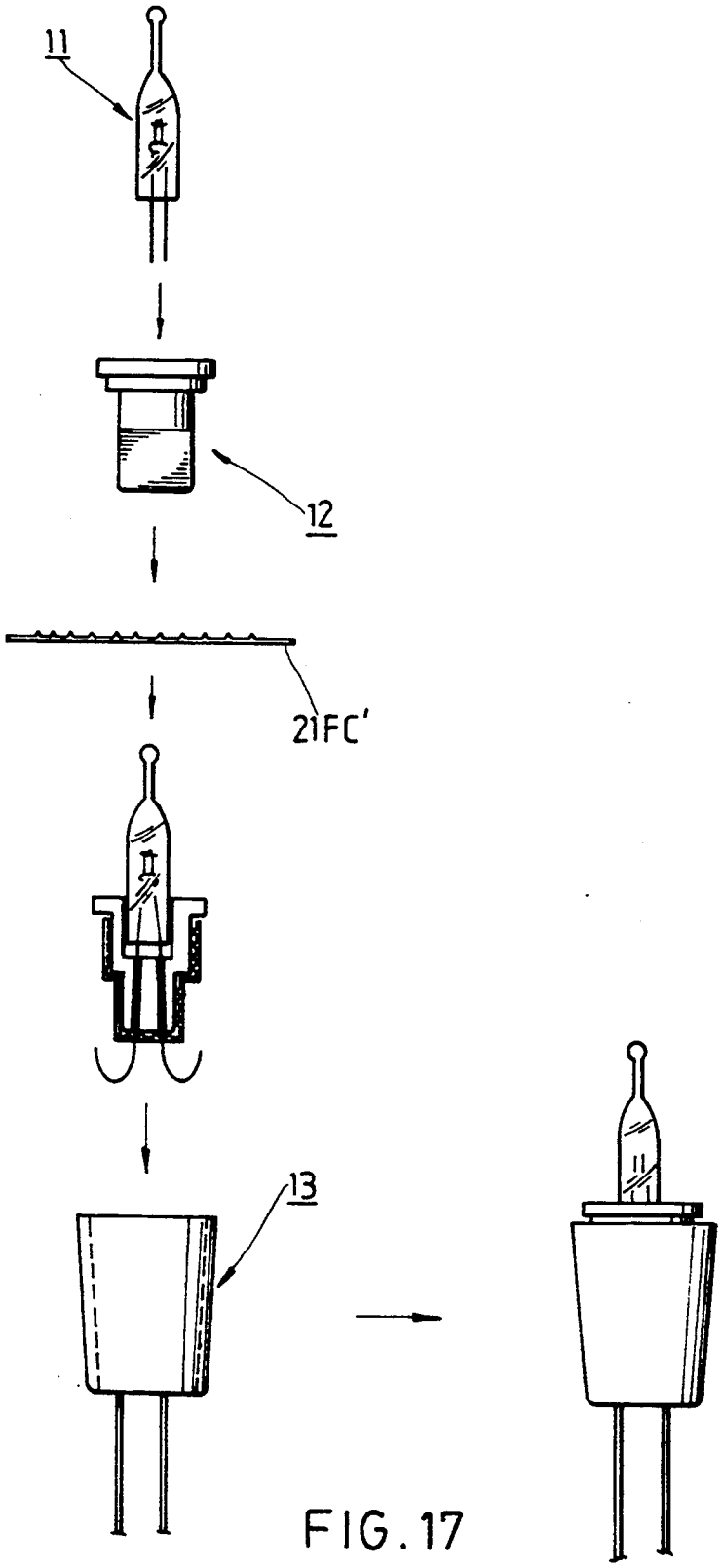

In FIG. 17, still another embodiment is shown in which the full length insert strap 21FC' has no holes at its ends. There are also no lugs on the lamp holder 13. The rest is just the same as described in FIG. 15, except that no anchoring operation is performed.

Figure 18:
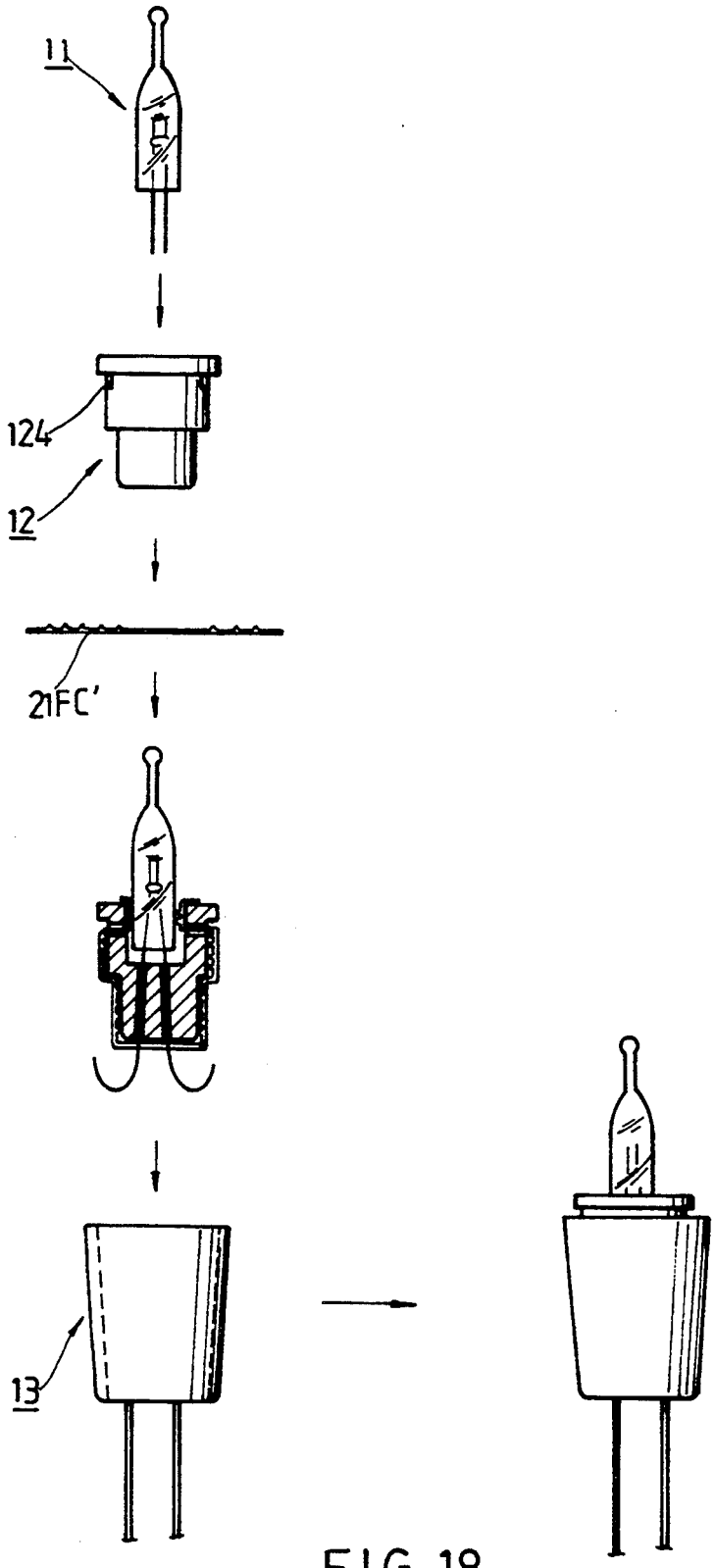

In FIG. 18, still another embodiment is shown in which the full length insert strap 21FC' has no holes at its ends. There are also no lugs on the lamp holder 13. The rest is just the same as described in FIG. 15, except that no anchoring operation is performed.

Figure 19:
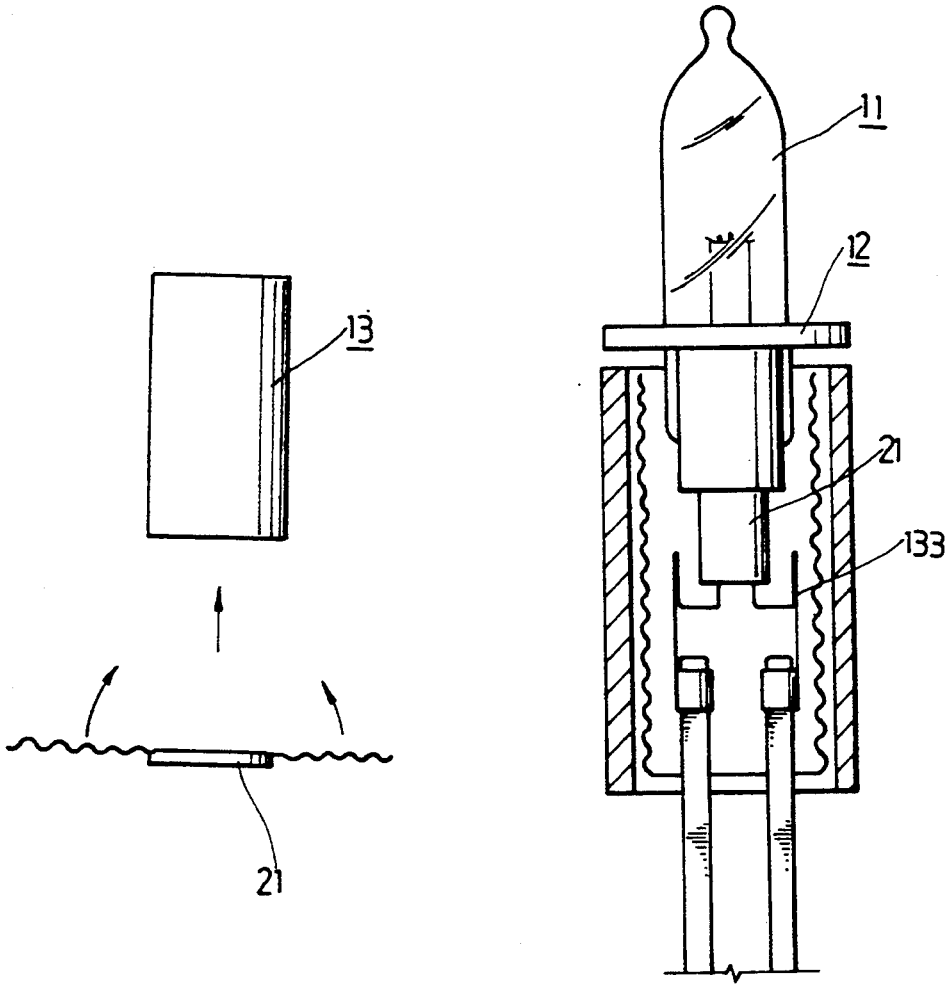

In FIG. 19, still another embodiment is shown in which an insert strap 21 is with or without the holes at its ends. Each of the two ends of the insert strap is inserted into the hole for the conductors at the outer side from the bottom of a lamp holder. When the lamp base and the lamp bulb are pushed into the lamp holder from the top, the insert strap is disposed between, the lamp base and lamp holder, the contact and lamp holder, and/or the conductor and the lamp holder to form a secured lamp-base-holder assembly.

Figure 20B:
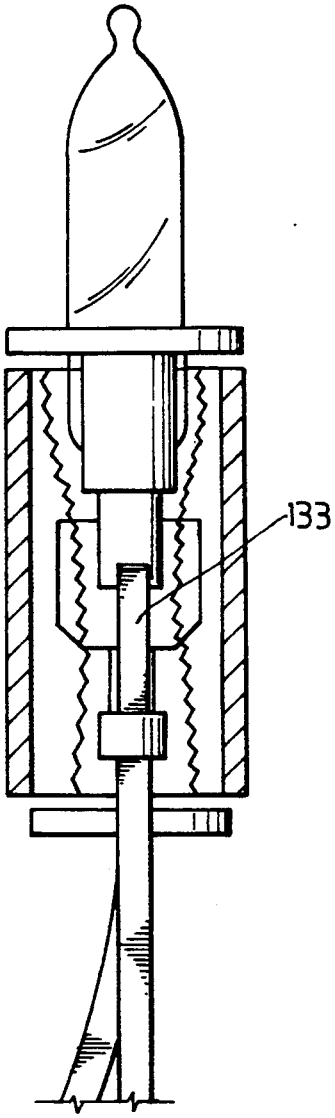
Figure 20A:
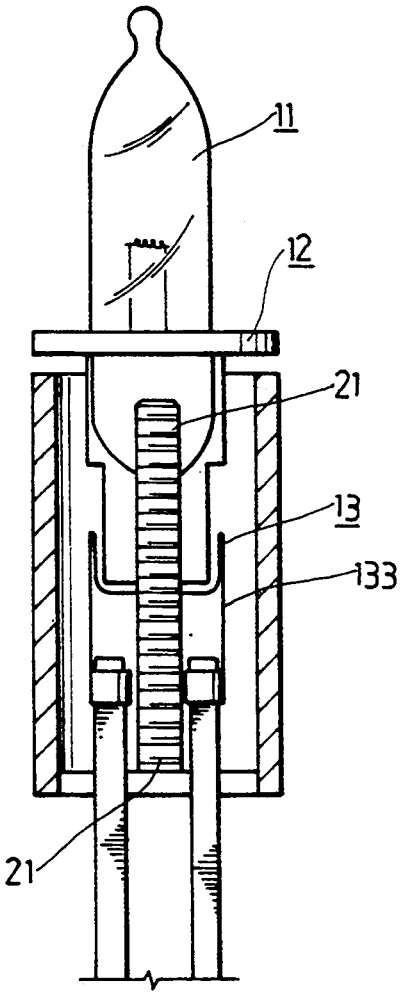

In FIG. 20A, yet another embodiment is shown in which an insert strap 21 is with or without the holes at its ends. Each of the two ends of the insert strap is inserted into the hole for the conductors at the inner side from the bottom of a lamp holder. When the lamp base and the lamp bulb are pushed into the lamp holder from the top to form a secured lamp-base-holder assembly, the insert strap is disposed between the lamp base and the lamp holder and in the spaces between the two contacts or two conductors to be a separator thereof.

FIG. 20B is the right side view of FIG. 20A.

Figures 21A, 21B, 21C:
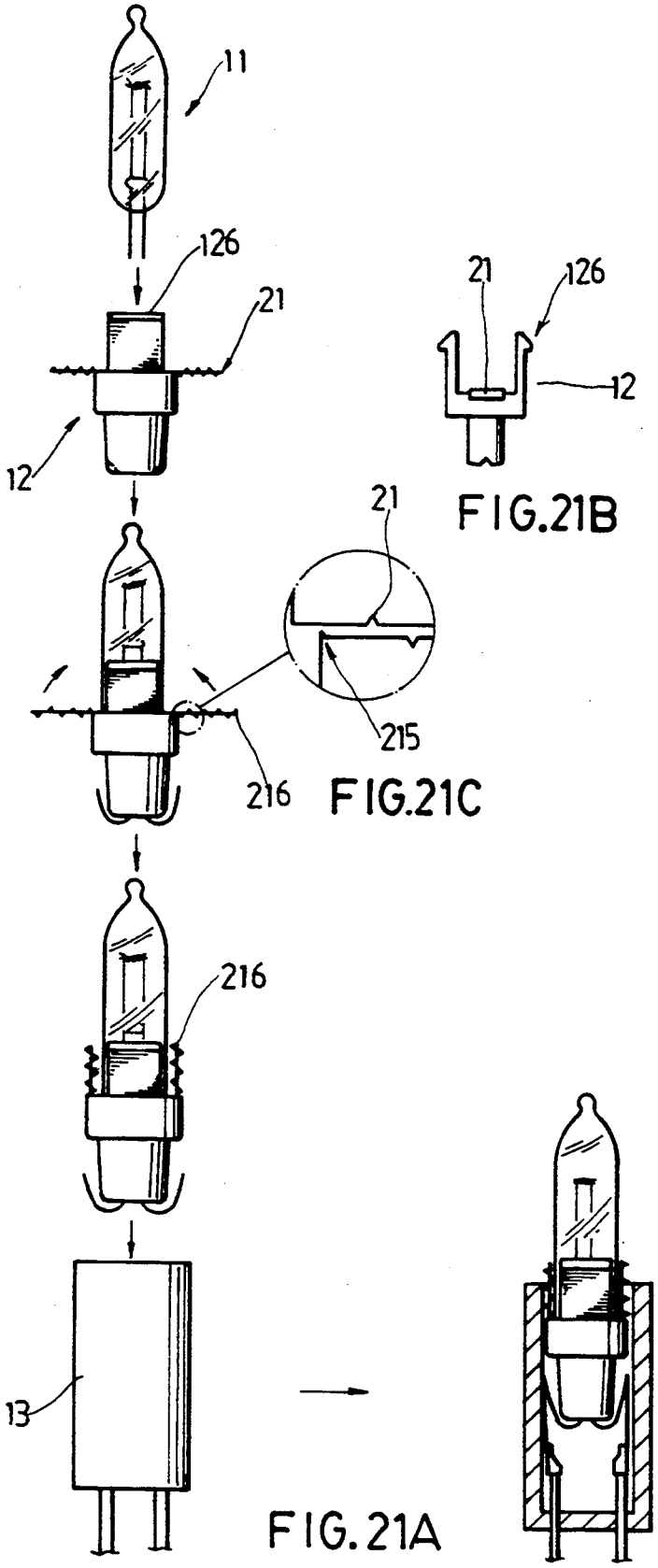

In FIGS. 21A and 21B, still another embodiment is shown with two half-length insert straps 21 formed integrally and diagonally on the middle part of the lamp base 12. These two straps 21 embossed with raised ribs and/or dots at least on one of two surfaces thereof have a grooved folding line 215 under or on each strap and close to the lamp base 12 in order to facilitate bending the strap 21 upward while the lamp base 12 is inserted into the lamp holder 13. The lamp base has two slits along the periphery thereof, which is just formed above the strap and has a width wide enough to fit the bending strap 21. It is best shown in FIG. 2lB of the side view of the lamp base 12 in this embodiment. As shown in the exploded view of FIG. 21A, the rough surfaces of the strap 21 shall retain the lamp bulb 11 and the lamp holder 13 on both sides thereof and a top rim 216 which is formed at the free end of a strap 21 can fix the lamp base 12 at a right position. The top rim 216 is also used as means to pull out the base 12 from the lamp holder 13.

Figures 22A, 22B, 22C:
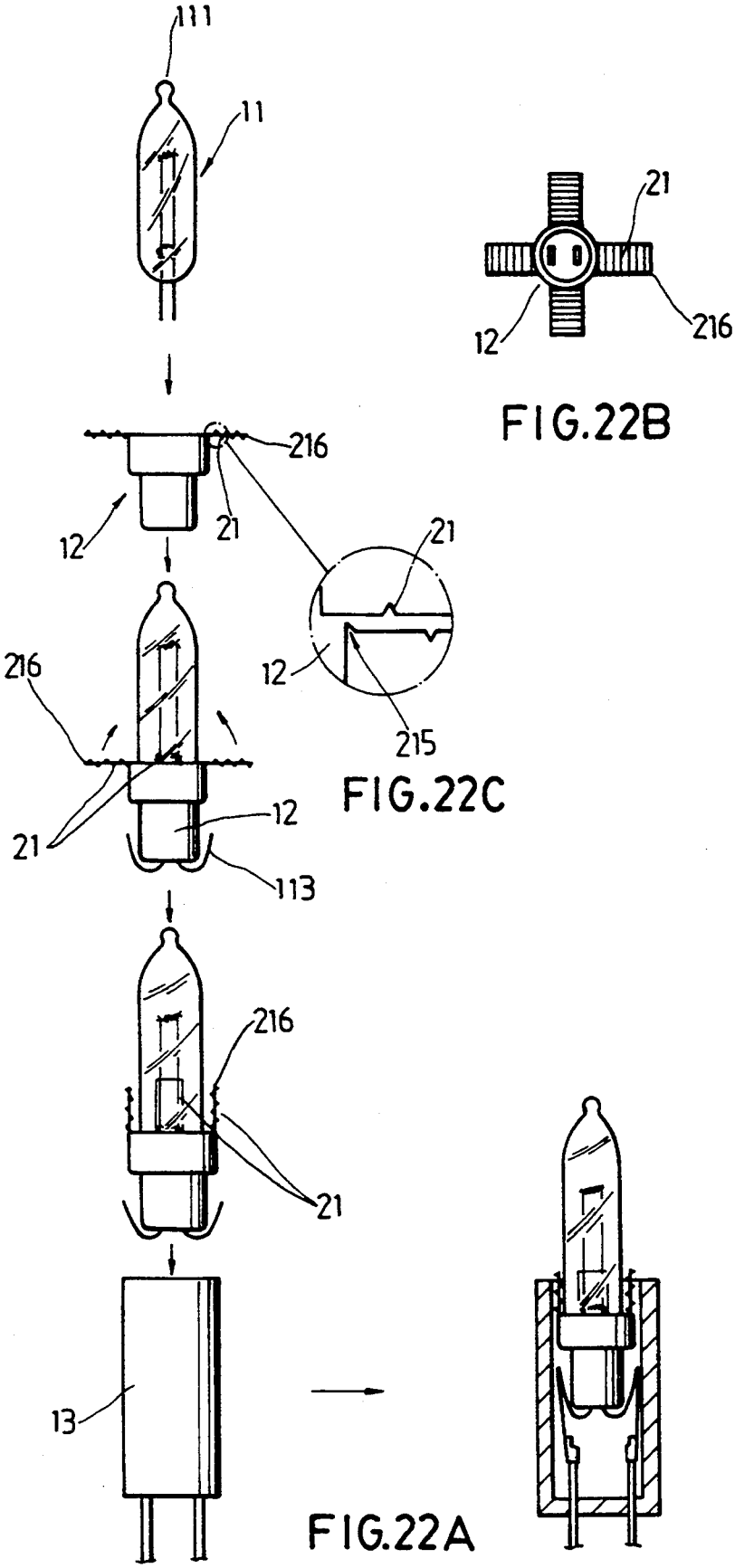

In FIGS. 22A, 22B, and 22C yet another embodiment is shown with four insert straps 21 formed on the top rim of a lamp base 12 which is substantially half the length of a normal lamp base 12 described above. The inserting straps 21 have raised ribs and/or dots at least on one of the surfaces of these straps 21 and a grooved folding line 215 is formed at one end under or on the strap 21 close to the lamp base 12 for facilitating the upward bending of straps 21. It is shown in the enlarged view of FIG. 22A. During assemblage, the straps 21 are bent upward to form a cylindrical shape with their free ends to form a top rim 216. The straps 21 can retain tightly the lamp bulb 11 and the lamp holder 13 between the side surfaces tightly by friction, and the top rim 216 can stop the lamp base 12 at a right position when the lamp base 12 is inserted into the lamp holder 13. FIG. 22A is an exploded view according to this embodiment and FIG. 22B is a top view of the lamp base 12 with the four straps 21 made according to this embodiment.

The features and preferred embodiments of the present invention have been described in the foregoing specification. The invention intended to be protected herein, however, is not to be construed as limited to the particular forms disclosed. Variations and changes which may be made by those skilled in the art are without departing from the scope of the present invention.

What is claimed is:

1. Push-in type socket unit for a decorative lighting string comprising a lamp bulb, a lamp base, a lamp holder, insert means, and a pair of conductor wires, said lamp bulb having a front end and a rear end, said lamp base having a front end and a rear end, said lamp holder having a front end and a rear end, said conductor wires leading from said rear end of said lamp bulb, passing through the rear end of said lamp base to come into contact with a pair of terminals located in said lamp holder, said insert means having a roughened surface and being capable of frictional contact, said insert means being disposed between the rear end of said lamp bulb and the front end of said lamp base, to effect stable fitting of said unit through said frictional contact of said insert means, wherein the insert means is in the form of at least one strap, and the surface thereof is toughened by means of at least one of embossing raised ribs and dots thereon, wherein said lamp holder has lugs on the front end thereof, the insert means is a strap formed as a continuous length having two free ends and a center section and each free end of the strap is provided with snapping hole for anchoring said respective lugs and the unit comprises transverse folding lines on the length of said strap and passages in said center section of the strap for said conductor wires.

2. The unit according to claim 1 wherein said lamp base has a wall, said wall has through-holes, said through-holes engage with said roughened surface of said strap to enhance frictional contact.

3. The socket unit according to claim 2 wherein the lamp base has a step.

4. The unit according to claim 1 wherein the lamp base has an outer surface and said outer surface is made with a step to facilitate integral connection with said strap thereupon.

5. The unit according to claim 1 wherein the lamp base has a rim and at least two holes are formed on the lamp base below said rim, said strap has two ends, both ends of said strap being inserted through said holes and the strap is bent over the rim, and the lamp bulb and the lamp base are secured frictionally by said strap.

6. Push-in type socket unit for a decorative lighting string comprising a lamp bulb, a lamp base, a lamp holder, insert means, and a pair of conductor wires, said lamp bulb having a front end and a rear end, said lamp base holder having a front end and a rear end, said lamp holder having a front end and a rear end, said conductor wires leading from said rear end of said lamp bulb, passing through the rear end of said lamp base to come into contact with a pair of terminals located in said lamp holder, said insert means having a roughened surface and being capable of frictional contact, said insert means being disposed between the rear end of said lamp bulb and the front end of said lamp base, to effect stable fitting of said unit through said frictional contact of said insert means, wherein the insert means is in the form of at least one strap, and the surface thereof is roughened by means of at least one of embossing raised ribs and dots thereon, wherein the insert means is in the form of a continuous strap having two ends, one end is integrally formed with said lamp base and another end is dangling, said strap has passages for said conductor wires, said lamp base has a front opening, said strap is bent inwardly over said front opening and is inserted between said bulb and said lamp base.

7. Push-in type socket unit for a decorative lighting string comprising a lamp bulb, a lamp base, a lamp holder, insert means, and a pair of conductor wires, said lamp bulb having a front end and a rear end, said lamp base having a front end and a rear end, said lamp holder having a front end and a rear end, said conductor wires leading from said rear end of said lamp bulb, passing through the rear end of said lamp base to come into contact with a pair of terminals located in said lamp holder, said insert means having a roughened surface and being capable of frictional contact, said insert means being disposed between said lamp base and the front end of said lamp holder to effect stable fitting of said unit through said frictional contact of said insert means, wherein the insert means is in the form of a plurality of straps, each strap having two ends, one end of which is integrally formed with the lamp base and another end is free dangling, said dangling end is bent outwardly and is inserted between said lamp base and said lamp holder.

8. The unit according to claim 7 wherein said lamp base has a middle part, said lamp base has a periphery, said plurality of straps comprises two half-length straps formed diagonally on said middle part of said lamp base, each one half strap has two surfaces and has raised ribs embossed on at least one of the surfaces thereof, said strap has a folding line, said strap bending upwardly, said lamp base has at least two slits on said periphery, said slits being wide enough to hold said upwardly bending straps which retains the lamp bulb and lamp holder tightly.

9. The unit according to claim 7 wherein said lamp base has a middle part, said lamp base has a periphery, said plurality of straps, comprises two half-length straps formed integrally on said middle part of said lamp base, each half-length strap has two surfaces and has raised ribs embossed on at least one of the surfaces thereof, said strap has a folding line, said straps bending upwardly, said lamp base has at least two slits on said periphery, said slits being wide enough to hold said upwardly bending strap which retains the lamp bulb and lamp holder tightly.

10. The unit according to claim 7 wherein said insert means consist of four straps, each of said straps has two surfaces, have raised ribs on at least one of said surfaces and have a folding line, said straps being bent upwardly.

11. Push-in type socket unit for a decorative lighting string comprising a lamp bulb, a lamp base, a lamp holder, insert means, and a pair of conductor wires, said lamp bulb having a front end and a rear end, said lamp base having a front end and a rear end, said lamp holder having a front end and a rear end, said conductor wires leading from said rear end of said lamp bulb, passing through the rear end of said lamp base to come into contact with a pair of terminals located in said lamp holder, said insert means having a roughened surface and being capable of frictional contact to effect stable fitting of said unit through said frictional contact of said insert means, wherein the insert means is in the form of at least one strap, and the surface thereof is roughened by means of at least one of embossing raised ribs and dots thereon, the insert strap is formed as a continuous length having two ends and a center section, and passages in said center section of the strap for said conductor wires, wherein said lamp holder has a hole, said lamp holder having an outer side and an inner side, said ends being inserted through said hole from the rear end of said lamp holder from the outer side thereof and when the lamp base and the lamp bulb are pushed into the lamp holder, the insert strap is disposed between the lamp base and the lamp holder, and between the lamp holder and the conductor wires to form a secured lamp-base-holder assembly.

12. Push-in type socket unit for a decorative lighting string comprising a lamp bulb, a lamp base, a lamp holder, insert means, and a pair of conductor wires, said lamp bulb having a front end and a rear end, said lamp base having a front end and a rear end, said lamp holder having a front end and a rear end, said conductor wires leading from said rear end of said lamp bulb, passing through the rear end of said lamp base to come into contact with a pair of terminals located in said lamp holder, said insert means having a roughened surface and being capable of frictional contact to effect stable fitting of said unit through said frictional contact of said insert means, wherein the insert means is in the form of at least one strap, and the surface thereof is roughened by means of at least one of embossing raised ribs and dots thereon, the insert strap is formed as a continuous length having two ends and a center section, and passages in said center section of the strap for said conductor wires, wherein said lamp holder has a hole, said lamp holder having an outer side and an inner side, said ends being inserted through said hole from the rear end of said lamp holder to the inner side thereof and when the lamp base and the lamp bulb are pushed into the lamp holder, the insert strap is disposed between the lamp base and the lamp holder, and between the lamp holder and the conductor wires to form a secured lamp-base-holder assembly.

* * * * *